US006663024B2

(12) United States Patent
Boecking

(10) Patent No.: US 6,663,024 B2
(45) Date of Patent: Dec. 16, 2003

(54) COMPACT HIGH-PRESSURE RESISTANT INJECTOR FOR FUEL INJECTION

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/069,728

(22) PCT Filed: May 25, 2001

(86) PCT No.: PCT/DE01/02026

§ 371 (c)(1),
(2), (4) Date: May 23, 2002

(87) PCT Pub. No.: WO02/01062

PCT Pub. Date: Jan. 3, 2002

(65) Prior Publication Data

US 2002/0148906 A1 Oct. 17, 2002

(30) Foreign Application Priority Data

Jun. 29, 2000 (DE) ..... 100 31 573

(51) Int. Cl.[7] ..... F02M 59/00; F02M 61/00; F02M 63/00; F02M 41/16; F02M 47/02

(52) U.S. Cl. ..... 239/533.2; 239/96; 239/533.8; 239/585.5

(58) Field of Search ..... 239/96, 533.2, 239/533.8, 585.5, 533.1, 533.3, 533.9, 533.11, 585.4, 585.1, 88, 89, 91, 93, 95; 251/129.15, 129.21, 127

(56) References Cited

U.S. PATENT DOCUMENTS 6,079,641 A * 6/2000 Shinogle et al. ..... 239/533.4
6,247,452 B1 * 6/2001 Dittus et al. ..... 123/459

FOREIGN PATENT DOCUMENTS

DE 19744518 * 4/1999 ..... F02M/41/00

* cited by examiner

*Primary Examiner*—Michael Mar
*Assistant Examiner*—Darren Gorman

(57) ABSTRACT

The invention relates to an injector for injecting fuel into combustion chambers of an internal combustion engine. The injector includes an injector housing, in which a control chamber is embodied that can be subjected to a control volume via an inlet throttle. The control chamber can be pressure-relieved to an actuator-actuatable control element as a result of which a control part is movable vertically in the injector housing. The control part and the nozzle needle are embodied integrally.

7 Claims, 1 Drawing Sheet

COMPACT HIGH-PRESSURE RESISTANT INJECTOR FOR FUEL INJECTION

CROSS-REFERENCE TO RELATED APPLICATIONS

This application is a 35 U.S.C. 371 application of PCT/DE 01/02026, filed on May 25, 2001.

BACKGROUND OF THE INVENTION

1. Field of the Invention

In injectors for injecting fuel into combustion chambers of internal combustion engines, the high-pressure resistance of the injectors that can be used is primary. In existing injector designs whose housings include a separate nozzle inlet and a nozzle chamber surrounding the nozzle needle, and given the constantly increasing pressure level in the high-pressure collection chamber (common rail), their high-pressure resistance is becoming increasingly important in terms of their usability, and such injectors are reaching the limits to their high-pressure resistance.

2. Prior Art

German Patent DE 37 28 817 C2 relates to a fuel injection pump for internal combustion engines. The control valve member used in this fuel injection pump comprises a valve shaft, forming a guide sleeve and sliding in a conduit, and a valve head connected to the valve shaft and oriented toward the actuating device. The sealing face of the valve head cooperates with a face of the control bore that forms the valve seat. The valve shaft has a recess on its circumference, and the axial length of this recess extends from the orifice of the fuel supply line as far as the beginning of the valve head sealing face that cooperates with the valve seat, and in the recess, a face exposed to the pressure of the fuel supply line is formed. This face is equal in area to a face of the valve head that is exposed to the pressure of the fuel supply line, in the closed state of the control valve. As a result, in the closed state the valve is in pressure equilibrium; in addition, a spring element spring that loads the control valve toward its open position is disposed in the guide sleeve of the control valve member.

SUMMARY OF THE INVENTION

With the compact design proposed according to the invention of an injector for injecting fuel into combustion chambers of internal combustion engine, its high-pressure resistance can be increased considerably, since the nozzle supply line and the nozzle chamber, which surrounds the nozzle needle in the region of its discharge into the combustion chamber, can now be omitted. A much more compact design of an injector can thus be attained, which furthermore is considerably easier to manufacture from the standpoint of production technology. The nozzle needle in the injector configuration proposed according to the invention no longer takes on any sealing function. Guidance of the nozzle needle in the housing of the injector can therefore be provided without canting in guide regions, which can be smaller than in nozzle needle guides that also perform a sealing function. A smaller area can therefore be machined with higher surface quality, which has a positive effect on the production costs for the injector proposed according to the invention.

An integral embodiment of control parts and nozzle needle that are embodied as merging with one another makes it possible to dispose a spring element that generates high closing forces in the housing of the injector. As a result, the closing time of the nozzle needle on its seat can be favorably affected, so that the incident leakage losses in the injector proposed according to the invention, of compact design, can be kept within narrow limits.

Because fuel that is at extremely high pressure is delivered substantially vertically, and its inflow is into an annular gap surrounding the control part, incident pulsations or pressure fluctuations in the delivered fuel can be better damped, and in particular are not propagated during the injection phase, so that the shaping of the precisely defined injection course is unimpaired by pulsations in the fuel.

Another advantage intrinsic to the embodiment according to the invention is considered to be that the nozzle needle can be provided with inlet faces, by way of which fuel entering via the annular gap between the nozzle needle and the injector housing flows to the seat of the injection nozzle. The delivery of fuel through annular gaps is the primary way of achieving substantially greater high-pressure resistance of the injector proposed according to the invention, since the nozzle inlet and the nozzle chamber can be omitted. Besides the advantages of easier production and greater attainable durability, the elimination of the line system to the nozzle needle makes a substantially faster pressure buildup at the injection nozzle tip possible.

BRIEF DESCRIPTION OF THE DRAWINGS

The invention will be described in detail below in conjunction with the drawings, in which.

DESCRIPTION OF THE PREFERRED EMBODIMENTS

Figure 1:
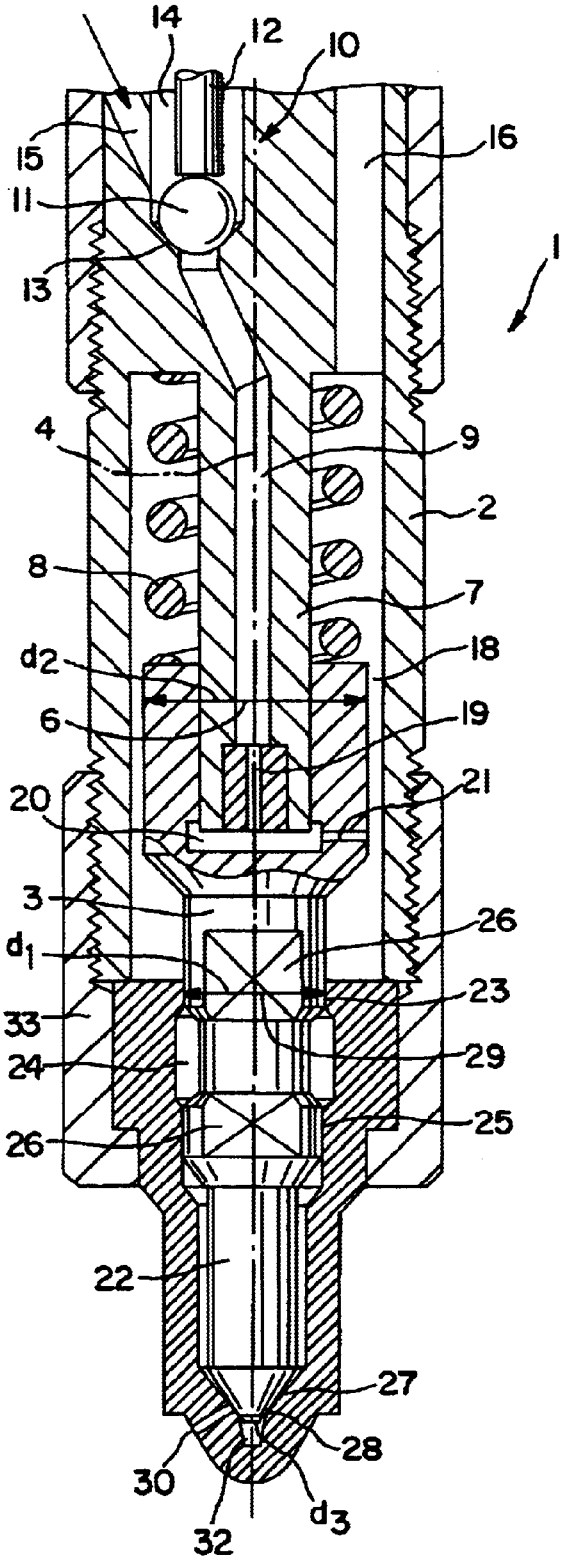
FIG. 1, the longitudinal section through an injector of the invention, with an integrally embodied control part and nozzle needle.

The view in FIG. 1 is of a longitudinal section through an injector configured according to the invention, with an integrally embodied control part and a nozzle needle immediately adjoining the control part.

The injector 1 embodied according to the invention includes an injector housing 2, in which a control part 3 with a cup-shaped recess is received. The control part 3 is embodied with an outer diameter $d_2$ in its upper region, which outer diameter $d_2$ is also identified by reference numeral 6, and is received movably on the outer face of a guide The guide 7 is embodied on the injector housing 2 of the injector 1 as a tubularly extending structural component extending parallel to the axis of symmetry 4 of the injector, and this component is surrounded on its outer face by a spring element 8, which by way of example can be embodied as a spiral spring. The spring element 8 is braced with its windings on one end on the annularly extending outer diameter region 6 of the control part 3, and on the other end it is braced in an annular recess in the injector housing 2. In the interior of the guide 7, which extends essentially coaxially to the axis of symmetry 4 of the injector 1, a through bore 9 is provided. An outlet throttle element 19 is let into the guide 7 on the face end of the guide 7; the through bore extending coaxially to the axis of symmetry 4 discharges, below a ball-shaped sealing element 11, into a hollow chamber 14 of an actuator-actuated control element 10.

In the configuration of FIG. 1, the actuator-actuated control element 10 is integrated with the injector housing 2.

The aforementioned through bore 9 in the guide 7 discharges on one end into the hollow chamber 14 of the actuator-actuated control element 10, and on the other, a leak fuel outlet 15 branches off from the hollow chamber 14 of the actuator-actuated control element 10. In the view shown in FIG. 1, the upper end of the through bore 9 of the guide 7 is closed by a ball-shaped sealing element 11, which is pressed into its sealing seat 13 by a thrust bolt 12. The closing force at the sealing element 11 is generated by the subjection of the thrust bolt 12 to a piezoelectric actuator, an electromagnet, or a hydraulic-mechanical converter, whose configuration is not shown in further detail in the view of FIG. 1.

In the upper part of the injector housing 2 of the injector 1 in terms of the view in FIG. 1, a substantially vertically extending inlet 16 from the high-pressure collection chamber (common rail) is shown. The inlet 16 discharges into the hollow chamber that receives the spring element 8, and from there, the fuel that is at extremely high pressure flows around the control part 3 and flows along an annular gap 18 in the direction of the nozzle needle 22. The annular gap 18, which is formed between the jacket face of the control part, embodied with the outer diameter 6 ($d_2$) and the inside face of the injector housing 2, serves to damp vibration or pulsation in the fuel, which is at high pressure, upon its delivery into the interior of the injector housing 2. Via an inlet throttle 21, embodied in the side wall of the control part 3 in the outer diameter region 6, the fuel at high pressure enters the control chamber 20, which is defined on the one hand by the face end of the guide 7, in which an outlet throttle 19 is provided, and on the other by the bottom of the cup-shaped interior of the control part 3.

Below the control chamber 20 the outer diameter $d_2$ of the control part 3 narrows to a guide diameter 29, in which (see the illustration in FIG. 2) guides 23 and 25 are embodied, which are intended for the nozzle needle 22. The guide regions 23 and 25 can be embodied as rings extending annularly along the jacket of the nozzle needle 22, which are guided in a correspondingly configured bore of the injector housing 2. The upper guide region 23 and the lower guide region 25 no longer assume any sealing function; instead, between the two guide regions 23 and 25, an annular hollow chamber 24 that forms an annular gap is formed, where the fuel at high pressure flows in upon a pressure relief of the control chamber 20 and a vertical motion of the control part 3 together with the nozzle needle 22.

From the lower guide 25, the fuel flows into an annular gap 31 (see the view in FIG. 2) surrounding the lower part of the nozzle needle 22, as far as the nozzle tip 32. Embodied on the nozzle tip 32 is a seat 27, by way of which the bore 30 protruding into the combustion chamber of an internal combustion engine can be closed and opened. The seat bottom 28 is embodied with a reduced diameter $d_3$.

The injector housing 2 of the injector 1, in the view of FIG. 1, is screwed into a socket 33 and can be unscrewed from the socket by simple rotation, once the lead line connections have been removed.

Figure 2:
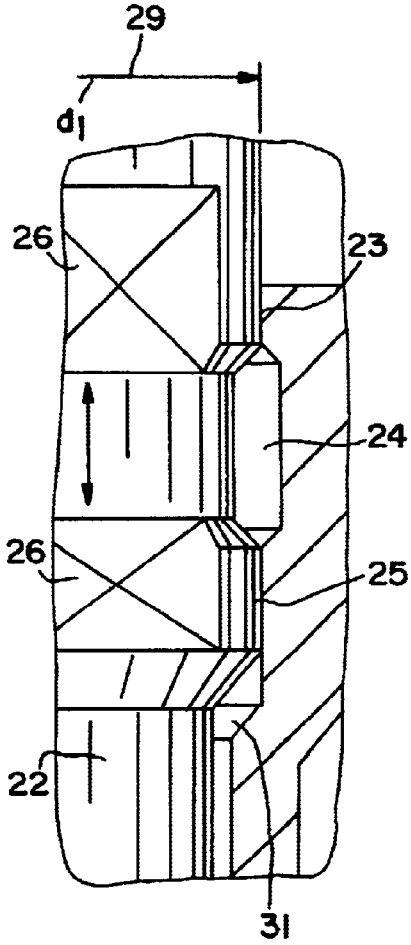
FIG. 2, an enlarged view of the guide region of the nozzle needle in the injector housing, with inlet faces for the fuel to the injection nozzle tip.

Below the transitional region between the control part 3 and the nozzle needle 22, inlet faces 26 for the fuel delivery to the nozzle tip 32 are embodied on the nozzle needle 22. The inlet faces 26 extend in the upper guide region 23 and the lower guide region 25 of the nozzle needle 22, and as a result the upper inlet face 26, as shown in FIG. 2, is in communication with the lower inlet face 26 above the inlet ring or annular gap 31, via the annular gap 24 created between the nozzle needle jacket face 22 and the housing bore. This assures that via the inlet faces 26, in the case of opening of the nozzle needle 22 as a result of a pressure relief of the control chamber 20, fuel is pumped as far as the nozzle tip 32 of the injector housing 2, where it can be injected into the combustion chamber of an engine.

The function of the injector shown in the views in FIG. 1 and FIG. 2 is as follows: By triggering of the control element 10, the thrust bolt 12 acting on the sealing element 11 is relieved, as a result of which the through bore 9 disposed essentially parallel to the axis of symmetry 4 is subjected to fuel emerging from the control chamber 20. Via the outlet throttle 19 let into the face end of the guide 7, the control volume flows into the through bore and from there through the uncovered sealing seat 13 into the hollow chamber 14 and from there out via the leak fuel line 15.

By opening of the control element 10, the pressure and the fuel volume in the control chamber 20 decrease, as a result of which the cup-shaped control part 3 is moved vertically upward along its guide face on the guide 7. During the upward motion, the annular edge of the control part 3, acted upon by the spring element 8, rests on and compresses the spring element 8. During the upward motion of the control part 3, the nozzle needle 22 moves out of its seat in the injector housing 2, so that the fuel supply available on the high-pressure side can flow laterally via the inlet faces 26 into the annular hollow chamber 24 and from there, via the lower inlet face 26, enters the gap between the jacket of the nozzle needle 22 and the inner wall of the injector housing 2. As a result, the requisite injection pressure and the fuel volume required for injection into the combustion chamber of an internal combustion engine, which can be injected into the combustion chamber via the obliquely disposed bore 30, is available at the nozzle needle tip 32. Part of the diameter ($d_1$–$d_3$) is already force-balanced by means of the diameter $d_2$ of the outer region of the control part 3. If the spring element aid is dimensioned appropriately for a complete force equilibrium of the nozzle needle 22, optimal opening and closing of the nozzle needle 22 at the nozzle needle tip 32 can be established.

Conversely, if the control element 10 is positioned by actuation of an actuator, then the thrust bolt 12 acts on the sealing element 11 and closes the through bore 9 at the sealing seat 13. As a result, by the continuous replenishing flow of fuel at high pressure via the inlet throttle 21, a high pressure builds up in the control chamber 20. As the result of the buildup of pressure in the control chamber 20, the control part 3 moves vertically downward out along the guide 7, so that the nozzle needle 22 and its needle tip 32 move into their seat 27. The closing motion of the nozzle needle 22 in its seat 27 in the region of the nozzle tip 32 is reinforced by suitable dimensioning of the spiral spring 8 embodied as a compression spring, so that fast closure of the nozzle needle 22 ensues, and thus the leakage losses can be kept within narrow limits.

The foregoing relates to preferred exemplary embodiments of the invention, it being understood that other variants and embodiments thereof are possible within the spirit and scope of the invention, the latter being defined by the appended claims.

I claim:

1. An injector for injecting fuel into combustion chambers of an internal combustion engine, comprising:

an injector housing (2) in which a control chamber (20) is embodied that can be acted upon by a control volume via an inlet throttle (21) and can be pressure-relieved via an actuator-actuatable control element, as a result of which a control part (3) is movable in the vertical direction in the injector housing (2), the control part (3) and a nozzle needle (22) being embodied integrally, further comprising inlet faces (26) for the delivery of fuel to a tip (32) of the nozzle needle (22) provided on the nozzle needle (22), still further comprising annularly extending guide faces (23,25) embodied on the nozzle needle (22), and still further comprising an annular hollow chamber (24) disposed between the guide faces (23, 25).

2. The injector of claim 1 wherein the control part (3) is guided on a guide (7) of the injector housing (2).

3. The injector of claim 2 wherein the guide (7) is surrounded on the outside by a spring element (8) and is penetrated on the inside by a through bore (9) to a control element (10).

4. The injector of claim 2 wherein the face end of the guide (7) is provided with a throttle element (19) and defines a control chamber (20).

5. The injector of claim 4 wherein the control chamber (20) is defined by the bottom face of the control part (3) received on the guide (7).

6. The injector of claim 1 wherein the control part (3) in its outer diameter region (6) is surrounded by an annular gap (18) defined between the injector housing (2) and the control part (3), which gap can be subjected to fuel from a high-pressure collection chamber via an inlet (16).

7. The injector of claim 1 wherein the fuel is pumped through an inlet ring (31), provided below the guide faces (23, 25), to the nozzle tip (32).

* * * * *

UNITED STATES PATENT AND TRADEMARK OFFICE

CERTIFICATE OF CORRECTION

PATENT NO. : 6,663,024 B2
DATED : December 16, 2003
INVENTOR(S) : Friedrich Boecking It is certified that error appears in the above-identified patent and that said Letters Patent is hereby corrected as shown below:

Title page,
Insert item [74], as follows:
-- [74] *Attorney, Agent, or Firm* ----- RONALD E. GREIGG --

Signed and Sealed this

Twenty-seventh Day of April, 2004

JON W. DUDAS
*Acting Director of the United States Patent and Trademark Office*